United States Patent [19]

Kaiser

[11] 4,128,061

[45] Dec. 5, 1978

[54] SAFETY SYSTEM FOR A PROJECTILE FUSE

[75] Inventor: Hans Kaiser, Konigsfeld, Germany

[73] Assignee: Gebruder Junghans GmbH, Schramberg, Germany

[21] Appl. No.: 831,388

[22] Filed: Sep. 8, 1977

[30] Foreign Application Priority Data

Sep. 29, 1976 [DE] Fed. Rep. of Germany ..... 2643828

[51] Int. Cl.[2] ..... F42C 9/04

[52] U.S. Cl. ..... 102/249; 102/251

[58] Field of Search ..... 102/249, 251, 255, 257

[56] References Cited

U.S. PATENT DOCUMENTS

| | | | |
|---|---|---|---|
| 3,162,126 | 12/1964 | Weber et al. | 102/249 |
| 3,367,267 | 2/1968 | Combourieux | 102/249 |
| 3,616,756 | 11/1971 | Simmen et al. | 102/249 |
| 3,845,714 | 11/1974 | Kaiser | 102/249 X |
| 3,978,798 | 9/1976 | Backström et al. | 102/249 |

*Primary Examiner*—David H. Brown

*Attorney, Agent, or Firm*—Burns, Doane, Swecker & Mathis

[57] ABSTRACT

A fuse includes a detonator-carrying rotor which can be turned from an armed position to a safety position. A first safety mechanism is provided for preventing return of the rotor to the armed position until the projectile has been fired. An additional safety mechanism is provided which prevents the first safety mechanism from releasing the rotor until the additional safety mechanism is deactuated. The additional safety mechanism includes independently operable elements, one of which shifts from a safety position and the other of which shifts into a safety position, in response to acceleration in one direction.

6 Claims, 5 Drawing Figures

SAFETY SYSTEM FOR A PROJECTILE FUSE

BACKGROUND AND OBJECTS OF THE INVENTION

This invention relates to fuses for detonating projectiles and more particularly to a safety mechanism for preventing detonation until the projectile has been fired.

It has been proposed to provide a fuse comprising a detonator which is installed in a rotor and which is able to swivel together with this rotor into a safe position against the restoring force of a power-storing element. A restraining mechanism is provided comprising primarily an armature wheel and a swinging arm for regulating the return rate of the detonator when swiveling from the safe position after the firing of the projectile. A safety device is providing comprising a return system which includes two stable pins arranged paralle. These pins are subjected continuously to the pressure of axially compressed power-storing elements and are held reciprocally at certain axial positions by at least one locking ball or the like. These pins cause a locking of the restraining mechanism as well as the rotor in their safety positions and release the restraining mechanism in response to axial acceleration forces arising during the firing of the projectile.

A fuse of this type is known and described in German Pat. No. 1,097,326. The fuse is equipped with a dual safety device for the fuse-activating train. A detonator is mounted eccentrically within a rotor. When the rotor has been displaced from its firing position, the fuse-activating train is in a non-firing condition, and is held in such condition by a return system acting upon the rotor. The return system includes two stable pins movable under the influence of axial acceleration forces for the purpose of releasing the rotor. A restraining mechanism consisting of a swinging arm and an armature wheel engaging the rotor, provides the necessary firing tube safety. In addition thereto, there is provided another safety element which can be actuated manually at the outside of the fuse and which interacts with one stable pin of the return system and which effects a full neutralization of the fuse when in locking position.

It is an object of the present invention to provide a fuse where an additional safety device for the fuse-activating train is provided without the need for safety elements which are actuated manually from the outside.

It is an additional object to provide a fuse which is armed only by the axial acceleration forces occurring during the firing of a projectile, and where the safety mechanism of the fuse cannot be influenced by powerful impacts when transported, nor by any other jolts.

BRIEF SUMMARY OF THE INVENTION

The invention solves this problem in the case of a fuse of the above-defined type in that for the purpose of attaining an additional safety there is provided an additional safety system which functions in addition to, and independently of the first safety system. This additional safety mechanism comprises a plurality of safety pins which can be displaced independently of each other by axial accelration forces while overcoming spring loading. These safety pins engage the rotor in alternate fashion while the rotor is in its safe position, for the purpose of detaining the same. There is further provided a mechanical connecting element which operably couples the return system to the additional safety mechanism so that when the rotor is located in its safe position the rotor, as well as two stable pins of the return system, will remain in safe position and their release can be achieved only after the firing of the projectile by the termination of the relevant locking, with the additional safety system and the connecting element acting in conjunction.

THE DRAWING

DETAILED DESCRIPTION OF A PREFERRED EMBODIMENT OF THE INVENTION

Figure 1:
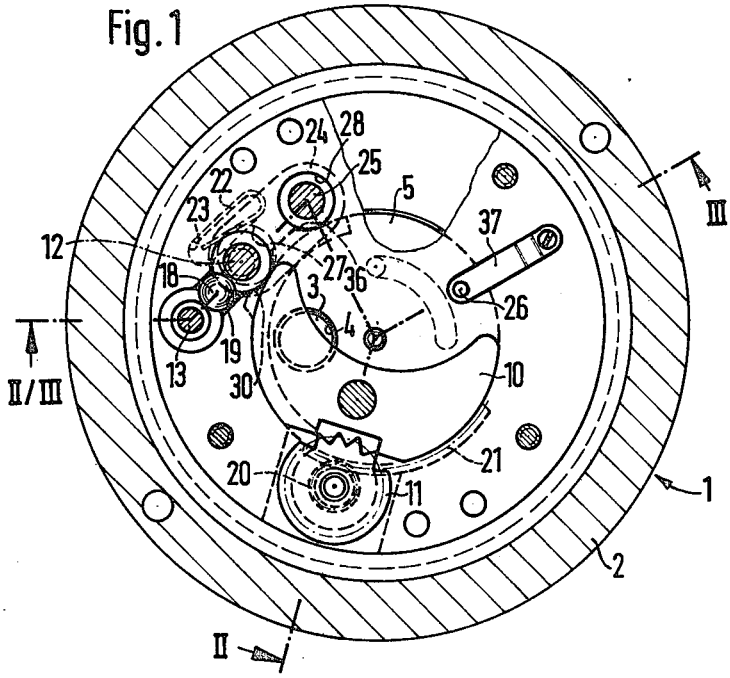
FIG. 1 is a cross-section of a fuse taken along line I—I in FIG. 2 with the detonator disposed in safe position.
Figure 2:
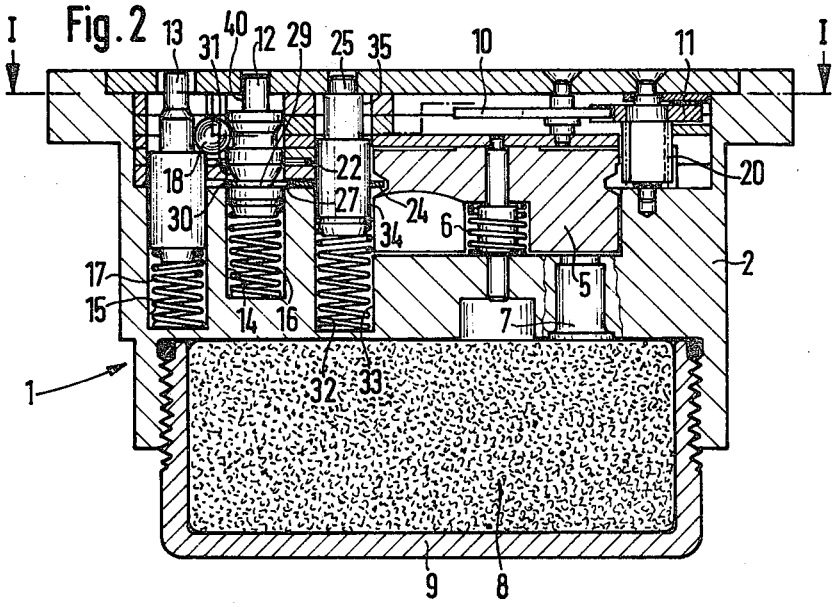
FIG. 2 is a longitudinal section of the fuse taken along line II—II in FIG. 1.
Figure 3:
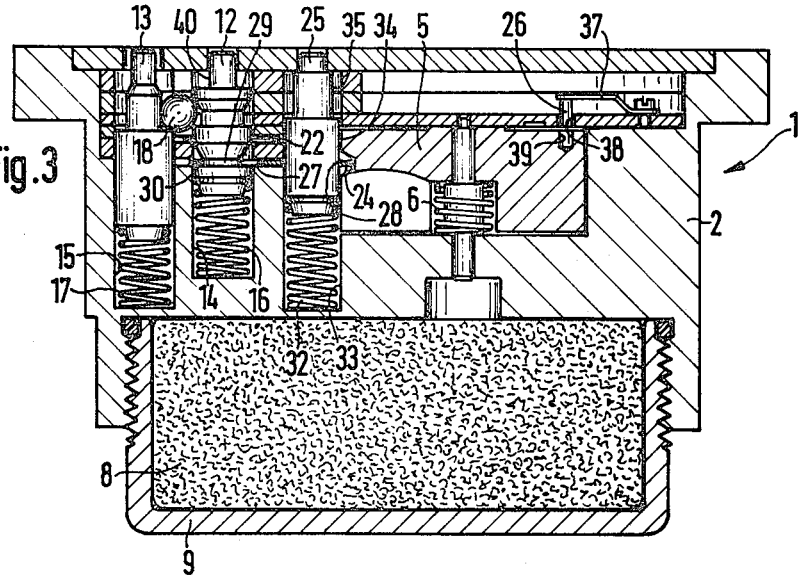
FIG. 3 is a cross-section of the fuse illustrated in FIG. 1 taken along line III—III in FIG. 1.

The figures depict a fuse, denoted by numeral 1, for large-caliber projectiles to be fired, with moderate rotation. The figures show only those parts of the fuse-activating train and its safety devices which are important and necessary for the understanding of the invention. It will be realized that a conventional fuse activating train can be employed in conjunction with the present invention. All parts are fully integrated in the interior of a fuse casing 2. The fuse-activating train comprises a detonator 3 which is inserted in an eccentric bore 4 of a rotor 5. The rotor 5 is rotatably mounted within the fuse casing 2. The detonator 3 can swivel together with the rotor against the force of a torsion spring 6 (FIG. 2) from the fuse-activating train into a safe position as illustrated in FIGS. 1 to 3. Insertion of the detonator 3 is followed by a primer charge 7 and a booster charge 8, the latter stored in a percussion cap 9 which is screwed to the fuse casing 2.

As safety devices for the fuse-activating train there are provided a firing pin return system and a restraining mechanism comprising a swinging escapement arm 10 and an armature wheel 11 some of whose teeth are depicted. The return system comprises a first stable pin 12 and a second stable pin 13, both being mounted axially movably in axially parallel bores 14 and 15, respectively, of the fuse casing. Each pin is yieldably backed by a compression spring 16 and 17, respectively. The pins are coupled to each other in a movement-controlling manner by a locking ball 18 which is arranged within the area between the pins and which engages slots or clearances machined into the pins. The locking ball 18 is guided within a slot 19 (see FIG. 1).

Figure 4:
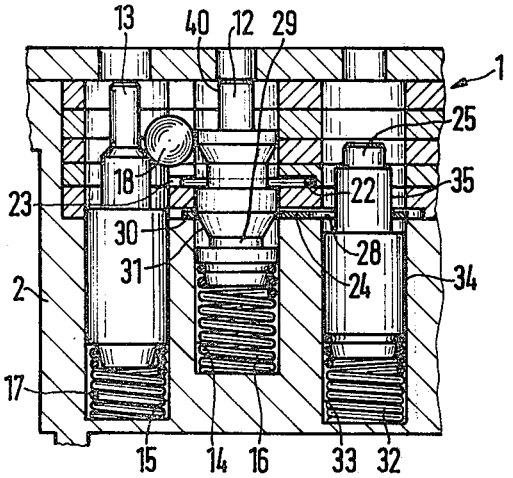
FIG. 4 shows in greater scale the parts of the safety device for the fuse-activating train in the process of being armed after the firing of the projectile.

The swinging arm 10 engages the cogging of the armature wheel 11 which in turn meshes by way of a pinion 20 with a segmentally shaped cogging 21 at the rotor 5. When placed at safety, the first stable pin 12 acts as detent for the rotor 5 when the latter has been swiveled into safe position. That is, the pin 12 intersects the path traveled by the swinging arm 10, thereby preventing any motion by this arm. Since the arm 10 is coupled to the rotor 5 via gearing 11, 20, 21, rotation of the rotor 5 is prevented as well. There is further provided a retaining spring 22 which is inserted under compression into a recess 23 of the fuse casing. This spring 22 co-acts with the first stable pin 12 in such manner that after the firing of a projectile (not shown) and a resulting axial movement of the pin 12 in a direction toward the projectile base, the pin 12 will be prevented from sliding back completely into its safe position shown in FIGS. 1 to 3. That is, the spring 22 will block such movement (FIG. 4).

For the purpose of providing an additional safety device for the fuse-activating train, the invention proposes the use of a safety system which is operably coupled to the return system by way of a connecting element 24. The additional safety system comprises two safety pins 25 and 26 which are independent of each other and which can be shifted by axial accelration forces against a spring loading. These pins 25, 26 are operable to engage the rotor 5 when in its safe position, for the purpose of detaining it. The two pins 25 and 26, respectively, are disposed parallel to the axes of the two stable pins 12, and 13, respectively, of the return system. The connecting element 24 is designed in the form of a locking member which comprises a flat sheet metal part with two bores 27 and 28. The first stable pin 12 of the return system passes axially through the first bore 27 of the connecting element 24. The first safety pin 25 of the additional safety system passes axially through the second bore 28. The first stable pin 12 is equipped with a radial groove 29 which is engaged in an axially locking manner by the connecting element 24 by means of an outer strip portion 30 thereof that is adjacent to the bore 27, when the rotor 5 is in its safe position. This radial groove 29 has a side wall 31 which tapers in the direction of the projectile head and which forms an approach ramp for laterally shifting the connecting element 24 as will be discussed. The safety pin 25 is disposed in a blind-end bore 33, with a compressed pressure spring 32 inserted in back of it. The pin 25 includes a cylindrical guide portion 34, and an extension bolt 35 possessing a smaller diameter to allow a lateral shift of the connecting element 24. When the safety pin 25 is in a position of rest (i.e., safety position), a radially protruding cam 36 of the rotor 5 (see FIG. 1) abuts against the guide portion 34, thus preventing a return of the rotor to the armed position.

The second safety pin 26 of the additional safety system (see especially FIG. 3) is placed at the outer free end of a leaf spring 37. The other end of the leaf spring is fastened to the fuse casing. The pin 26 is guided within a bore 38 in the fuse casing 2. This pin 26 can move under the influence of axial acceleration forces from its nonlocking rest position, illustrated in FIG. 3, into a bore 39 of the rotor, when the rotor is in its safe position.

The additional safety system serves in this case as a protection against impacts or jolts which could occur during the loading or the transport of the projectile. The two safety pins 25 and 26 function oppositely in that they alternately lock the rotor 5, depending on the direction of any acceleration forces acting upon the projectile. Note that when forces act upon the projectile to urge the pin 26 away from the bore 39, the pin 25 will be urged to a position blocking movement of the rotor, and vice versa.

The operation of the safety device for the fuse-activating train will now be explained in detail on the basis of FIGS. 3 to 5.

FIG. 3 shows all safety elements which take part in the locking of the rotor in its safe position, in their positions of rest. The fuse-activating train is held against operation when the rotor and the detonator 3 are displaced from the firing position. The return swivel by the rotor 5 into the armed position is not initiated until the occurrence of axial acceleration forces during the firing of the projectile. When the projectile is being fired, the first safety pin 25 of the additional safety system slides backwardly, overcoming the force of the pressure spring 32 (see FIG. 4) and thus releasing the rotor 5. However, the second safety pin 26 of the alternate safety system simultaneously enters the bore 39 in the rotor 5, locking the same during the acceleration phase. The leaf spring 37 will eventually pull this pin 26 back to its original position immediately upon the conclusion of the projectile acceleration.

FIG. 4 shows also that during the firing of the projectile not only the first safety pin 25 but also the second stable pin 13 of the return system slides backwardly, overcoming the force of the compression spring 17. This allows the locking ball 18 to yield laterally so that the first stable pin 12, overcoming the force of the compression spring 16, can now slide backwardly. This backward movement by the first stable pin 12 causes, firstly, a lateral shift of the connecting element 24 by contact with the tapered side wall 31. This prevents the first safety pin 25 of the additional safety system from later sliding back into its locking position and terminating the protection of the rotor 5. Secondly, the locking spring 22 is released, whereby one of its legs enters a radial groove in the first stable pin 12, thus preventing this pin from a return to its locking position.

Figure 5:
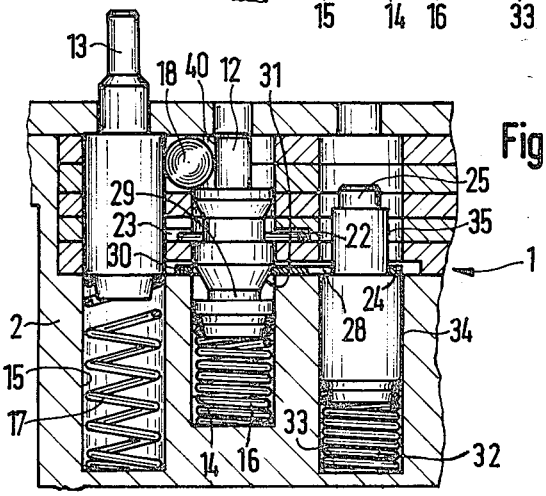
FIG. 5 shows in greater scale the parts of the safety device for the fuse-activating train in armed position after the firing of the projectile.

Moreover, the second stable pin 13 of the return system is eventually pushed forwardly by the spring 17 to the position illustrated in FIG. 5, carrying along axially the locking ball 18. The ball 18 is shifted laterally into a recess 40 of the first stable pin 12 and holding it in this position.

The rotor 5, under the influence of the expanding torsion spring 6, now begins to turn toward the armed position. This rotary movement occurs at a time delay by the restraining mechanism, which delay is proper and sufficient for firing barrel safety. Rotary movement occurs along an arc of approximately 90°. As soon as the cogging 21 of the rotor 5 disengages from the pinion 20 of the armature wheel 11, the rotor returns suddenly to its armed position, swinging at an arc of approximately 70°, thus closing the fuse-activating train pyrotechnically.

In accordance with the present invention, the interconnection of the first and additional safety mechanisms results in safety, characteristics which meet the strictest technical requirements. This safety device is secure from any unintentional handling or errors in servicing due to the integrated placement of all safety elements inside the fuse. The engagement of the rotor, located in its safe position in alternate fashion by the two safety pins of the additional safety system insures that impacts during transport or any other axial jolts cannot influence the fuse in any manner. The arming of the fuse can be accomplished exclusively by the axial acceleration forces arising during the firing of the projectile.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A fuse for detonating a projectile, said fuse being of the type comprising a rotatable rotor; a detonator carried by said rotor, said rotor and detonator being rotatable to displace said detonator from a firing position; power storing means energized in response to such displacement of said detonator to urge said rotor and detonator back toward the firing position; restraining means for controlling the rate of return of said detonator to the firing position, said restraining means comprising an armature wheel connected to said rotor, and a swinging arm connected to said armature wheel for regulating the rotation of said armature wheel to regulate the rate of rotation of said rotor; a safety mechanism comprising first and second pins arranged parallel to one another, axially compressed power storing elements urging said pins to a safety position in which one of said pins prevents rotation of said restraining mechanism; said pins being axially displaceable in response to firing of said projectile to release said restraining mechanism; and a locking ball disposed between said pins for being shifted into axial alignment with said one pin by the other pin to prevent return of said one pin to a safety position; the improvement comprising:

an additional safety mechanism which functions independently of said first-named safety mechanism, said additional safety mechanism comprising:

a plurality of safety pins displaceable independently of one another in response to acceleration forces such that one safety pin tends to release said rotor for rotation and the other tends to restrain said rotor from until acceleration diminishes;

spring means for resisting such displacement of said safety pins; and means connecting said additional safety mechanism and said first-named safety mechanism such that one of said safety mechanisms is actuable in response to acceleration forces to release said rotor only following displacement of the other of said safety mechanisms by the acceleration forces.

2. A fuse according to claim 1, wherein said second pin of said additional safety mechanism is mounted at the end of a leaf spring whose other end is fixed, said second pin being displaceable into a bore of said rotor in response to acceleration forces to prevent rotation thereof.

3. A fuse according to claim 1, wherein said connecting means is connected between said one pin of said first-named safety mechanism and with a first safety pin of said additional safety mechanism which tends to release said rotor in response to acceleration forces.

4. A fuse according to claim 3, wherein said connecting means comprises a plate having first and second bores, said first pin of said first-named safety mechanism disposed in said first bore and said first safety pin of said additional safety mechanism disposed in said second bore, said plate preventing axial displacement of one of said first pins until the other has been displaced with said one of said first pins then being displaced and simultaneously shifting said plate to prevent return of said other of said first pins to a safety position.

5. A fuse according to claim 4, wherein said other first pin comprising a first portion and a second portion of smaller diameter such that said plate is operable to be shifted into the path of said first portion to prevent return of said other first pin to a safety position; said other first pin being axially displaceable against a compression spring; said first portion, in its safety position, abutting against a projection of said rotor to prevent rotation thereof.

6. A fuse according to claim 4, wherein said one first pin includes a groove which is engaged by said plate to prevent displacement thereof until said other first pin is displaced, said groove including a tapered wall which engages said plate when said one first pin is displaced and cams said plate to a position blocking return of said other first pin to a safety position.

* * * * *